United States Patent [19]

Apel

[11] Patent Number: 4,719,549

[45] Date of Patent: Jan. 12, 1988

[54] CONNECTION BETWEEN TWO MECHANICALLY AND ELECTRICALLY RELEASABLY COUPLED PARTS, IN PARTICULAR FOR USE WITH AN ILLUMINATION SYSTEM

[76] Inventor: Volker H. P. Apel, Schulstrasse 10, D-8000 München 19, Fed. Rep. of Germany

[21] Appl. No.: 808,039

[22] Filed: Dec. 12, 1985

[30] Foreign Application Priority Data

Dec. 24, 1984 [DE] Fed. Rep. of Germany ..... 3447332

[51] Int. Cl.[4] ..... H01R 11/30

[52] U.S. Cl. ..... 362/398; 362/421; 439/40

[58] Field of Search ..... 339/12 R, 12 L, 182 RS; 362/421, 398, 147, 220, 225, 226, 388, 404

[56] References Cited

U.S. PATENT DOCUMENTS

| | | | |
|---|---|---|---|
| 2,004,105 | 6/1935 | Farish | 339/182 RS |
| 4,211,456 | 7/1980 | Sears | 339/12 R |
| 4,258,414 | 3/1981 | Sokol | 362/398 |
| 4,384,752 | 5/1983 | Gabriel | 339/12 R |
| 4,390,232 | 6/1983 | Jamgotchian | 339/12 R |
| 4,538,214 | 8/1985 | Fisher et al. | 362/398 |

FOREIGN PATENT DOCUMENTS

| | | | |
|---|---|---|---|
| 8121740 | 10/1981 | Fed. Rep. of Germany . | |
| 8304428 | 5/1983 | Fed. Rep. of Germany . | |
| 3350 | of 1882 | United Kingdom | 362/421 |

*Primary Examiner*—Craig R. Feinberg
*Assistant Examiner*—David A. Okonsky
*Attorney, Agent, or Firm*—Christie, Parker & Hale

[57] ABSTRACT

For a connection, in particular for use with an illumination system, two mechanically and electrically releasably coupled parts, in particular a magnetic holder (3) and a ball (4) which define a ball-and-socket joint, are provided, with said two parts (3) and (4) being interconnectable by means of magnetic force and contacting each other, the two parts (3, 4) establishing electrical contact for the lighting fixture (10) as a result of magnetic frictional contact.

24 Claims, 27 Drawing Figures

42
44
43
48
47
34
41
39
47
33

CONNECTION BETWEEN TWO MECHANICALLY AND ELECTRICALLY RELEASABLY COUPLED PARTS, IN PARTICULAR FOR USE WITH AN ILLUMINATION SYSTEM

DESCRIPTION

The invention relates to a connection between two mechanically and electrically releasably coupled parts, in particular for use with an illumination system.

In prior art illumination systems, in particular lamps, the parts to be connected have been mechanically coupled by means of screws, bolts and the like in order to establish a form-fit and frictional contact. As conductors live wires have heretofore been provided at the connection, for example a joint, either in a continuous manner or releasably attachable to the connections by means of luster terminals and the like.

The invention is based on the object of providing a constructionally simple connection of the type mentioned above which is extremely versatile and may be established and separated extremely easily.

According to the invention, this object is established in that the two parts are interconnectable by magnetic force and establish electrical contact through mutual contacting whenever magnetic frictional contact has been established.

The subject matter of the present invention is therefore magnets, in particular permanent magnets, which establish electrical contact concomitant to achieving magnetic frictional contact. Due to the direct combination of frictional contact and electrical contact, various technical problems can be solved in a particularly easy manner. For example, it is not necessary to use a live wire within the area of the connection, which results in an extremely simple and wear resistant assembly, in particular when the parts are connected in a flexible manner, for example by means of a ball-and-socket joint.

In a preferred embodiment of the invention the components of the connection may be a magnetic ball-and-socket joint of common construction, with the magnetic holder of the magnetic ball-and-socket joint preferably defining the basic part to which electrical power is supplied , and the ball, which is connected to the consumer via additional connecting members, being retained to the magnetic holder by frictional contact.

Alternatively, the basic part may also be in the form of a magnetic rail. In this case, the other part may also be shaped, for example, as a ball or cylinder and attached along the rail by magnetic force at any position desired.

According to an especially advantageous embodiment of the invention, one part of said two parts comprises two sections which are electrically separated from each other, and the other part comprises also two sections which are likewise electrically separated from each other, with the electrical separation of said individual sections being maintained when said parts are connected to one another. With the connection being arranged in this way, an electrical circuit may be closed using a single connection only, for example by means of a single magnetic joint, whereas otherwise two connections are required, which may, however, be of advantage for reasons of styling and lighting engineering.

If the electrical connection exhibits two electrical poles insulated from each other, as mentioned above, and the connection comprises a magnetic holder and a ball retained thereto by magnetic force, another advantageous feature of the invention allows for the arrangement of the connection being designed, in detail, in such a way that the magnetic holder has magnetic and physical contact with the ball via an annular surface, that the ball is formed with an internally arranged contact pin which projects from the ball's circumference and is electrically insulated from the ball, and that inside of the magnetic holder a contact surface insulated from the latter is arranged and contacts exclusively the contact pin of the ball when the ball is inserted.

According to further preferred embodiments of the invention, the contact surface appropriately exhibits a curved shape to match the shape of the ball and is formed with rest recesses for receiving the contact pin, which contact pin is preferrably spring-mounted in longitudinal direction between two extreme stops. Thus, specific preferred angle positions taken by the ball relative to the magnetic holder are defined in correspondence with the rest recesses in the contact surface.

When using a rail as magnetic holding member and a bipolar electrical connection, the rail is provided, according to a further embodiment of the invention, with a contact rail extending along its centre line and electrically insulated therefrom. When the second part is inserted, this contact rail contacts a contact element fixed to said second part and electrically insulated therefrom. This second part may again be a ball or, for example, a cylindrical element, with the axis of said cylindrical element extending parallel to the rail.

The connection of the invention is, inter alia, of particular advantage for use with an illumination system. If the connection is electrically unipolar, another embodiment of the invention is responsible for the illumination system being characterized by two basic connections, the electrical consumer being switched therebetween.

In this case, preferrably, at least one of said basic connections is electrically connectable to a further connection, with an intermediate element being connected therebetween. Said further connection is electrically connected to the other basic connection, with the electrical consumer switched therebetween, or to another connection operatively connected to said other basic connection via an interconnection defined by an intermediate member. Such an arrangement which comprises a plurality of flexible connections will meet the specific technical and artistic requirements made in each case on the illumination system in a most simple way.

If the connections are electrically bipolar, the illumination system may preferably be arranged in such a way that one basic connection is electrically connected via an intermediate member to a further connection, the latter being connected to the electrical consumer. When, for example, the connection is in the form of a magnetic ball-and-socket joint, this arrangement will result in an extremely flexible lamp due to the various degrees of freedom possible, which allows the lamp to be oriented in virtually any direction desired.

The intermediate members between the basic connection and the further connection may be in the form of a rod, a tube or an electroconductive rope for use with both, electrically unipolar and electrically bipolar connections. It may be of particular advantage to provide a telescopic element as intermediate member, since the artistic and luminous flexibility of the illumination will thus be enhanced.

According to another embodiment of the invention, it may be especially advantageous to provide a multitude of basic parts, in particular magnetic holders, and arrange them for graticule illumination, in particular on the ceiling and the like. When the magnetic holders, arranged for graticule illumination, are switched appropriately, a multitude of lamp configurations is rendered possible, and the lamps may be fixed to the ceiling at random positions in accordance with the specific array chosen for graticule illumination.

An illumination system according to the invention can be easily installed and/or modified, since bolting together mechanical parts is rendered superfluous and no electrical connections have to be established separately. The individual components of the system are simply joined and held together by magnetic force, which, at the same time, results in an electrical contact being established.

In the following, several embodiments of the invention will be described in more detail with reference to the accompanying drawings, with all these embodiments relating to lamp systems. It must, however, be emphasized again, that the connections according to the invention may also be advantageously used in other fields of engineering.

Figure 1:
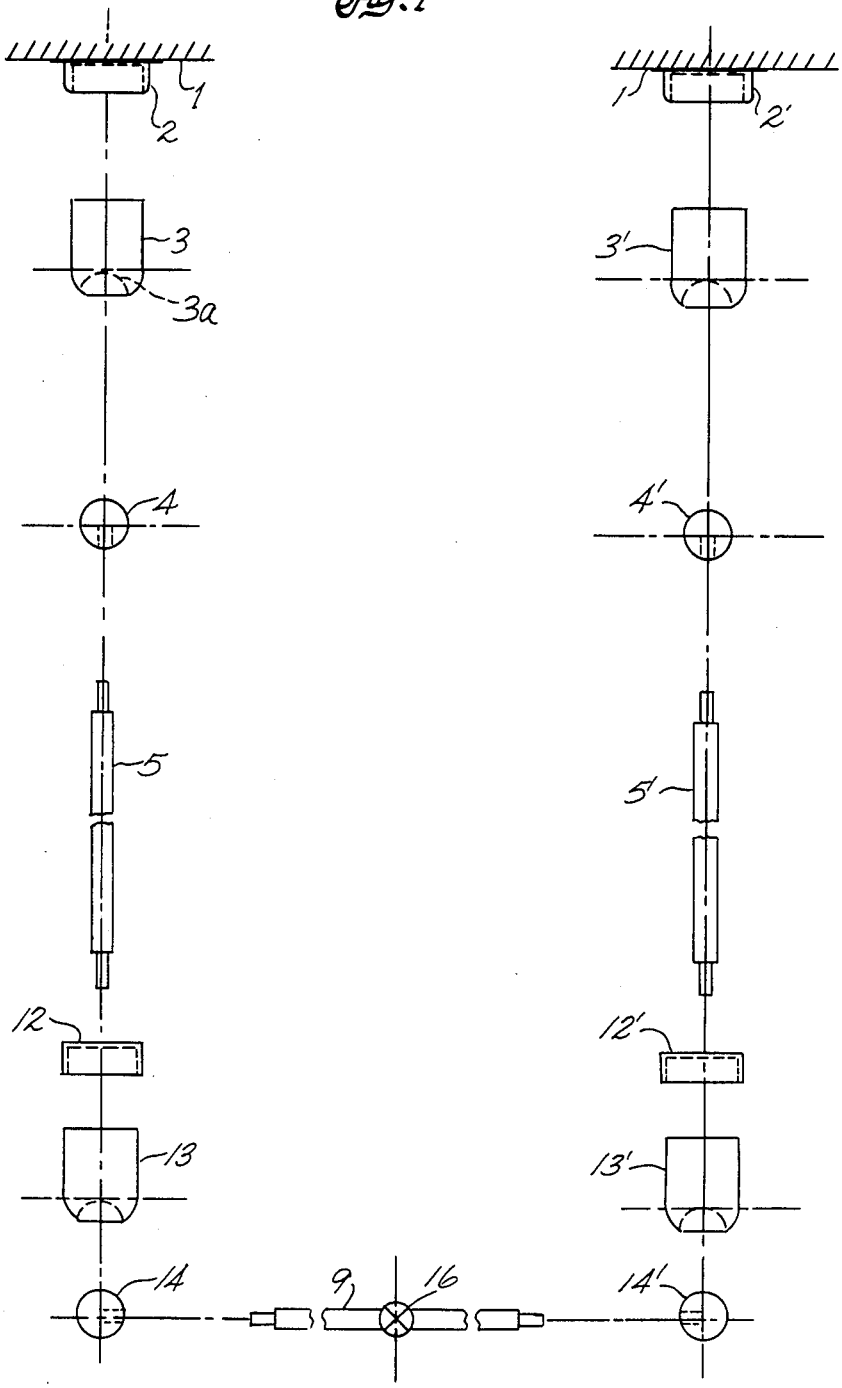
FIG. 1 shows a lamp with two electrically unipolar basic magnetic ball-and-socket joints.

According to FIG. 1, there are, for example, two holders 2, 2' secured to the ceiling 1 in spaced relationship by means of appropriate fasteners, for example bolts, screws and dowels or adhesives. A magnetic holder 3 is adapted to be inserted and locked into holder 2.

The end of magnetic holder 3 which is disposed away from holder 2 is formed with a hemispherical recess 3a for receiving a ball 4 made of a magnetic material. Magnetic holder 3 and ball 4 define a ball-and-socket joint as it is commercially available, for example from the company IBS-Magnet, Berlin.

One end of an elongated intermediate member 5, for example, an electroconductive rod, is connected rigidly and electroconductively to ball 4 (or, for example, by means of a thread) and the opposed end of said intermediate member is connected in the same way to a further holder 12 which is likewise adapted to receive a ball-and-socket joint consisting of magnetic holder 13 and ball 14.

Magnetic holder 3', ball 4', intermediate member 5', another holder 12', magnetic holder 13', and ball 14' are attached to holder 2' in the same way as described above.

All magnetic ball-and-socket joints shown in FIG. 1 are identical.

A connecting member 9 supporting lighting fixture 10 is rigidly and electroconductively connected with its opposed ends to ball 14 and 14', respectively.

Current flows from holder 2 and magnetic holder 3 via ball 4, intermediate member 5, said further holder 12, magnetic holder 13, ball 14, the left part of connecting member 9 to consumer 10 and from there back to magnetic holder 3' and holder 2' via the respective parts.

Figure 2:
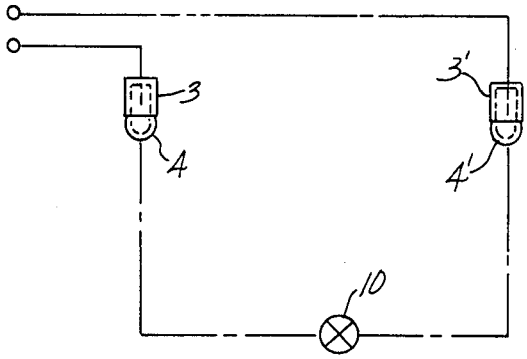
FIG. 2 is a schematic representation of the electrical power supply via two magnetic ball-and-socket joints.

The current path through the two magnetic ball-and-socket joints 3,4 and 3',4' shown in FIG. 2 is indicated by the segmented line and the magnetic circuit by the dotted line.

Figure 3:
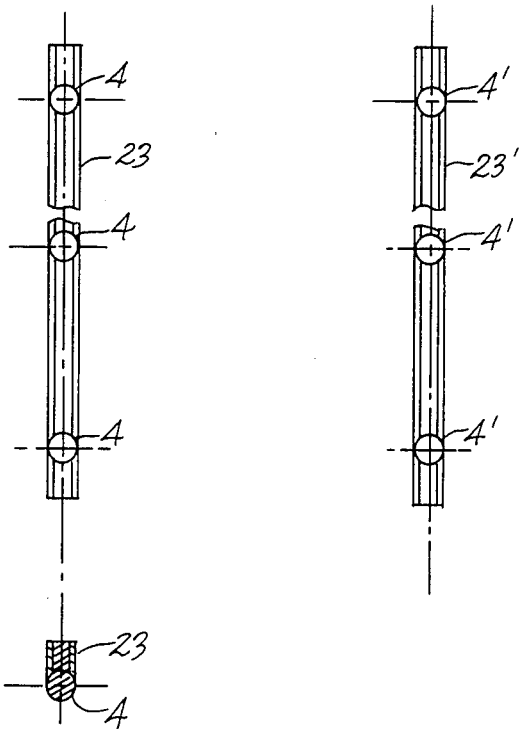
FIG. 3 shows a fundamental arrangement when electrically unipolar magnetic rails are used.

The magnetic holding element of FIG. 3 is a magnetic rail 23 or 23' which holds balls 4 at any position desired. As is in case of the magnetic holder of FIG. 1, the magnetic rail allows universal turns and swivels of the ball by 180°.

In the case of the embodiments described above, which use in each case two electrically unipolar magnetic joints that must contain sufficient conductive material in correspondence with the current load, each magnet is connected to one pole of an electrical circuit. Electrical contact is established as a result of frictional contact between a magnetic material (ball) and one of the two magnets (magnetic holders). When the magnetic material (ball) retained by the magnetic holder is connected to an electrical consumer and the other pole of the consumer and the second magnetic material (ball 4') are electroconductively connected, the electrical circuit closes as soon as the second magnetic holder is frictionally connected to this material.

The embodiments of FIGS. 4 to 8, which will be described hereinafter allow an electrical circuit to be closed with use of a single connection only.

Figure 4:
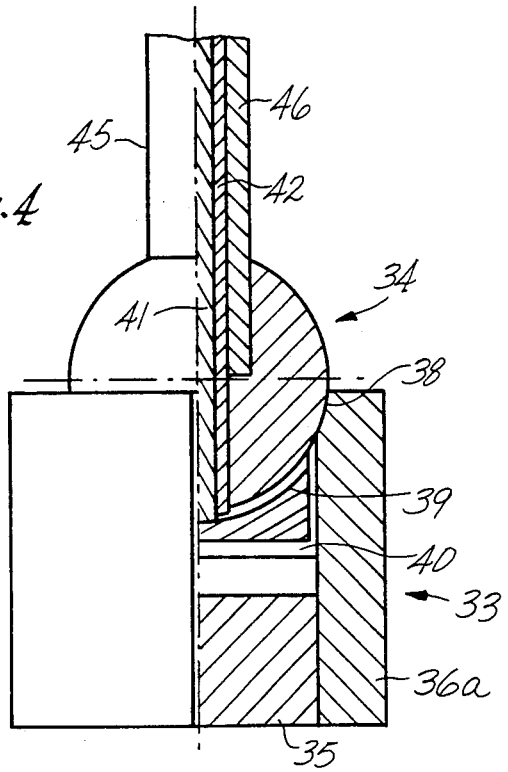
FIG. 4 is a partial sectional side view of an electrically bipolar magnetic ball-and-socket joint.
Figure 5:
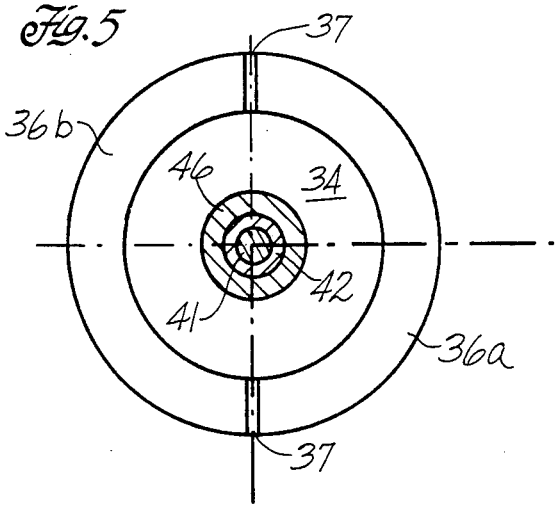
FIG. 5 is a top view of the magnetic ball-and-socket joint of FIG. 4.

Magnetic holder 33 of the magnetic ball-and-socket joint shown in FIGS. 4 and 5 is split up into two electrical poles insulated from each other. The electrical separation is performed such as to not impede the magnetic effect. The magnetic material, i.e. the ball 34, also contains two electrically insulated poles, which establish electrical contact in case of magnetic frictional contact.

It is inferrable from FIGS. 4 and 5 that magnetic holder 33 includes magnet 35 which establishes a magnetic circuit via two ferropoles 36*a*, 36*b* when the ball 34 is inserted. Said two ferropoles 36*a* and 36*b* are kept electrically separated from one another at position 37 by means of a non-magnetic material (MS,V2A,A1). The inner surfaces of ferropoles 36*a* and 36*b* facing permanent magnet 35 define an annular contact surface 38, the shape of which matches that of ball 34 and via which ball 34 is retained to magnetic holder 33 by means of magnetic force. Within magnetic holder 33 and below contact surface 38 there is another contact surface 39 which is electrically insulated from magnet 35 and ferropoles 36a and 36b by means of an appropriate insulation 40.

Contact surface 39 is shaped to match the shape of ball 34. When ball 34 is inserted, there is a small space between contact surface 39 and the surface of ball 34 so as to avoid the surface of the ball contacting surface 39.

Within ball 34 there is a contact pin 41 provided in center position, which pin is electrically insulated from the electroconductive ball by means of insulation 42. Contact pin 41 extends through ball 34 and along the longitudinal axis of intermediate member 45 which is attached to the ball, and is likewise insulated from said intermediate member 45 by means of insulation 42. The pin's end opposite to intermediate member 45 projects beyond the surface of ball 34 to such a degree that pin 41 abuts against contact surface 39 when ball 34 is attached to magnet holder 33, which results in an electrical contact being established between contact surface 39 and pin 41.

As a result, power is supplied, on the one hand, via ferropole 36a or 36b to ball 34 and outer tube 46 of intermediate member 45, and, on the other hand, via contact surface 39 to contact pin 41 of the ball or of the intermediate member.

Figure 6:
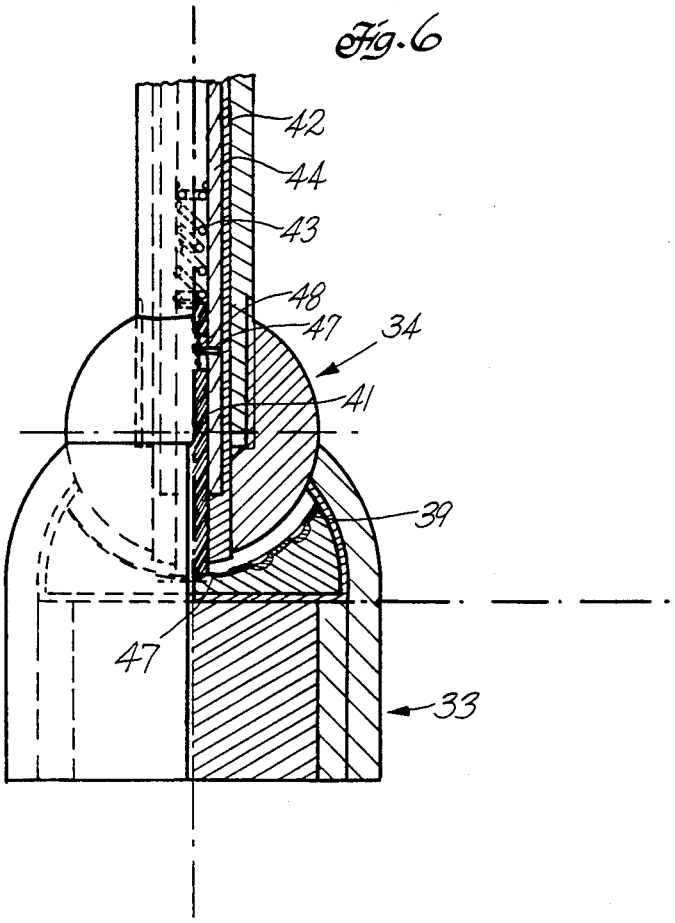
FIG. 6 shows a further embodiment of an electrically bipolar magnetic ball-and-socket joint.

The arrangement of FIG. 6 corresponds substantially to that of FIG. 4, except that contact pin 41, as depicted, is arranged for axial movement and is forced towards contact surface 39 by spring 43. Spring 43 also serves as a contact spring for establishing an electrical contact between contact pin 41 and an electrical conductor 44 disposed inside of intermediate member 45. A stop pin 47 engages the oblong hole 48 of pin 41, thus limiting the movements of contact pin 41.

As indicated in FIG. 6, contact surface 39 of this embodiment exhibits a dot raster 47 consisting of recesses and prominences so that ball 34 may engage a range of stable positions at magnetic holder 33.

Figure 7:
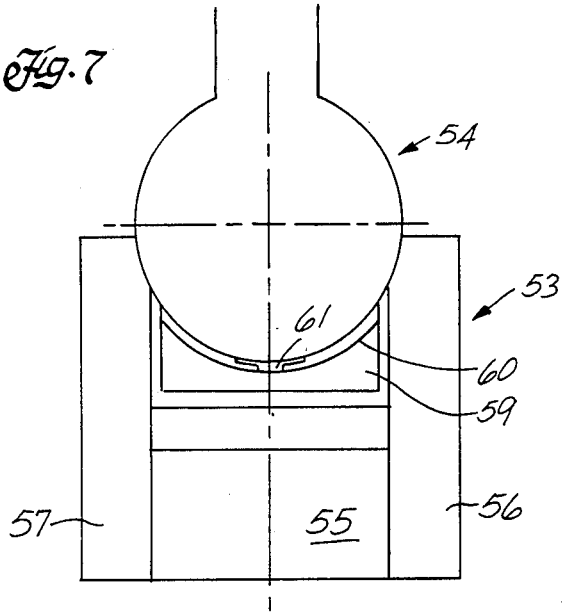
FIG. 7 is a side view of an electrically bipolar connection, with the magnetic holding member being a magnetic rail.
Figure 8:
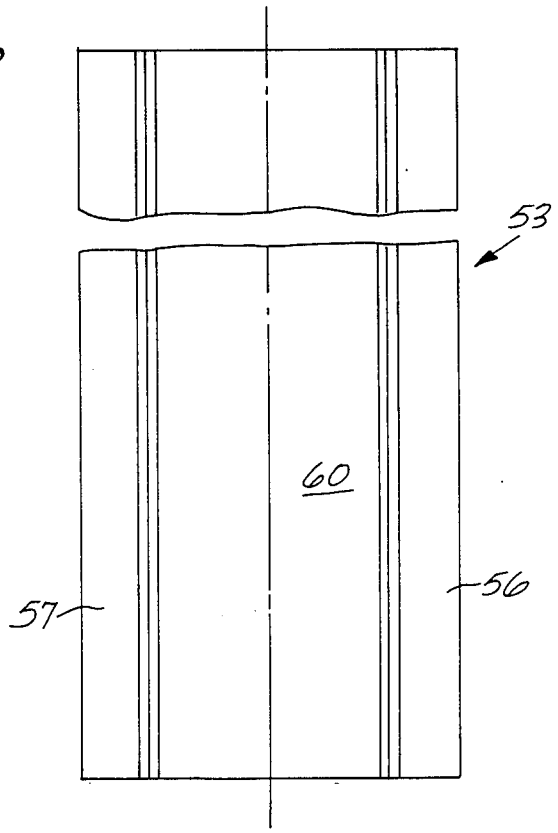
FIG. 8 is a top view of the magnetic rail of FIG. 7.
Figure 9:
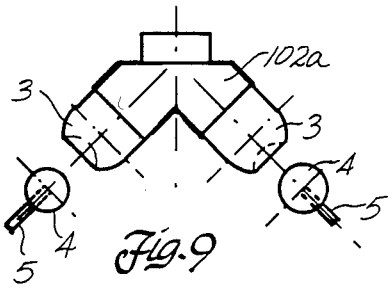
FIGS. 9 to 12 show various alternative embodiments of the holding member.
Figure 10:
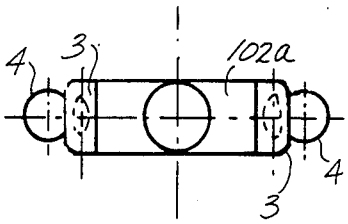
Figure 11:
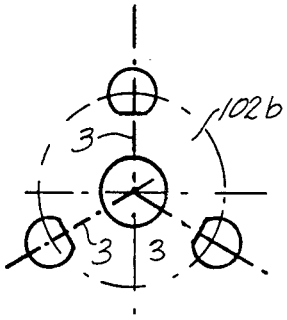
Figure 12:
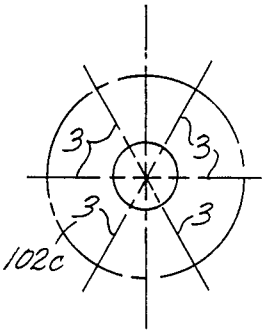

FIGS. 7 and 8 show an electrically bipolar magnetic connection, with the magnetic holder being defined by a magnetic rail 53. Magnetic rail 53 comprises a magnetic plate 55 extending along said rail and being laterally bordered by two plate-type ferropoles 56 and 57. In FIG. 7, a contact rail 59 with contact surface 60 is provided between magnetic poles 56 and 57 and above magnet plate 55, which contact rail extends along rail 53 and is insulated from all other parts of magnetic rail 53. Ball 54 with contact pin 61 is designed as described in the context of and represented in FIGS. 4 or 6 as well. With reference to its functioning, reference is made to the relevant explanations thereof. The swivelling range of ball 54 received by the magnetic rail of FIGS. 7 and 8 ranges between a minium of about 90° (in longitudinal direction of the magnetic rail) and a maximum of about 120° (transversely to the magnetic rail).

In order to enhance the magnetic holding force, ball 54, as outlined in FIG. 7, may be replaced by a corresponding cylindrical element, the axis of which runs parallel to the longitudinal direction of the rail. In this case, the cylindrical element and all parts attached thereto can be swivelled only transversly to the rail.

In the following, several variations of this system are described with reference to individually replaceable components.

FIGS. 9 to 12 illustrate that holders 102a may be used instead of the holder 2 shown in FIG. 1. These holders are adapted to receive two magnetic holder 3 (see FIGS. 9a and 9b) or, in the case of holder 102b, three magnetic holders (see FIG. 9c) or, in the case of holder 102c, six magnetic holders (see FIG. 9d).

Figure 13:
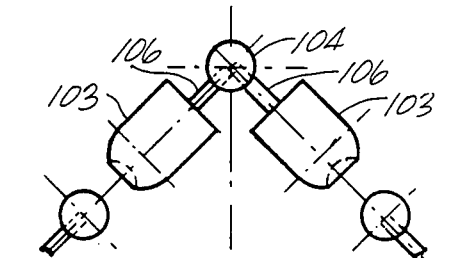
FIGS. 13 to 15 show various alternative embodiments of the ball of the magnetic ball-and-socket joint.
Figure 14:
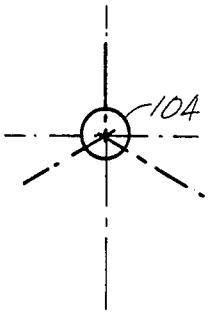
Figure 15:
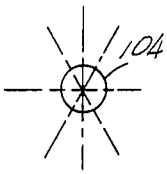

FIGS. 13 to 15 illustrate that ball 4 of, for example, FIG. 1 may be replaced for instance by ball 104 which supports further magnetic holders 103 via appropriately arranged rigid connecting members 106. FIG. 13 shows a two-armed version and FIGS. 14 and 15 represent a three-armed and six-armed version, respectively.

Figure 16:
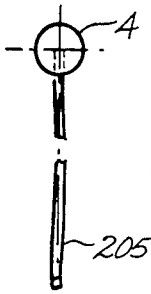
FIGS. 16 to 19 show various alternative embodiments of the intermediate members interconnecting two magnetic connections.
Figure 17:
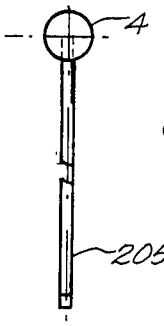
Figure 18:
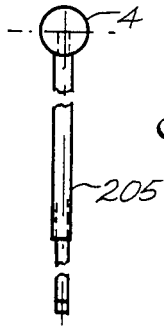
Figure 19:
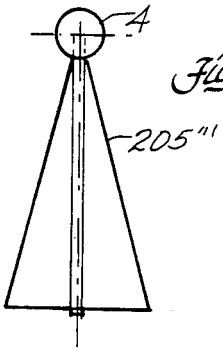
Figure 20:
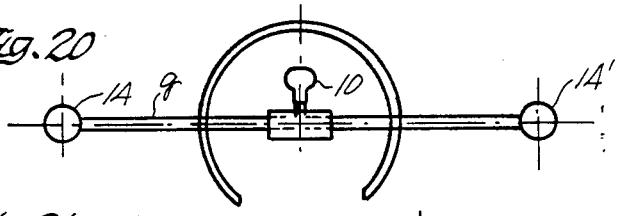
FIGS. 20 to 24 show various embodiments of lighting fixtures to be switched between two electrically unipolar magnetic connections.
Figure 21:
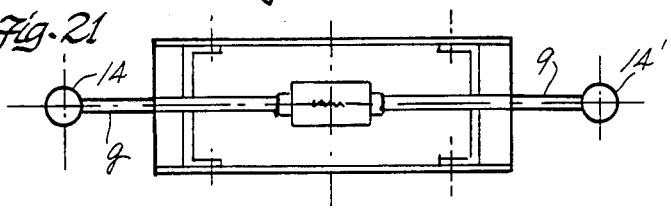
Figure 22:
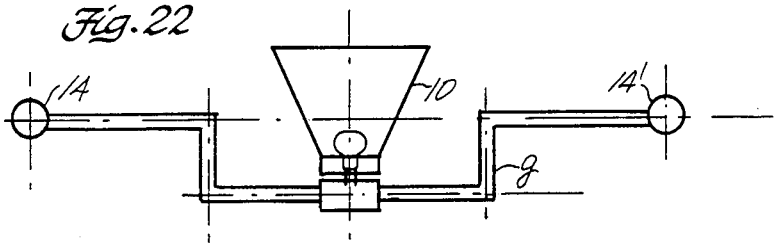
Figure 23:
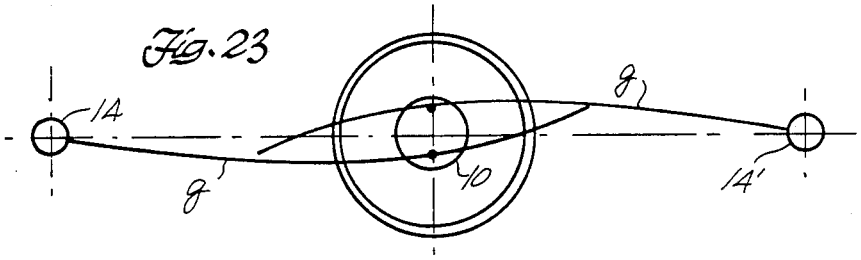

FIGS. 16 to 19 show some possible preferred embodiments of intermediate members. The intermediate member 205 of FIG. 16 is a slack rope. In FIG. 17 it is a rod or tube, in FIG. 18 a telescopic member and in FIG. 19 a non-conductive plastic plate furnished with an electroconductor 206. All intermediate members 205 may be of various and deliberate length depending on the application desired. The same variations are possible for holders and magnetic holders to be attached to the intermediate members.

Figure 24:
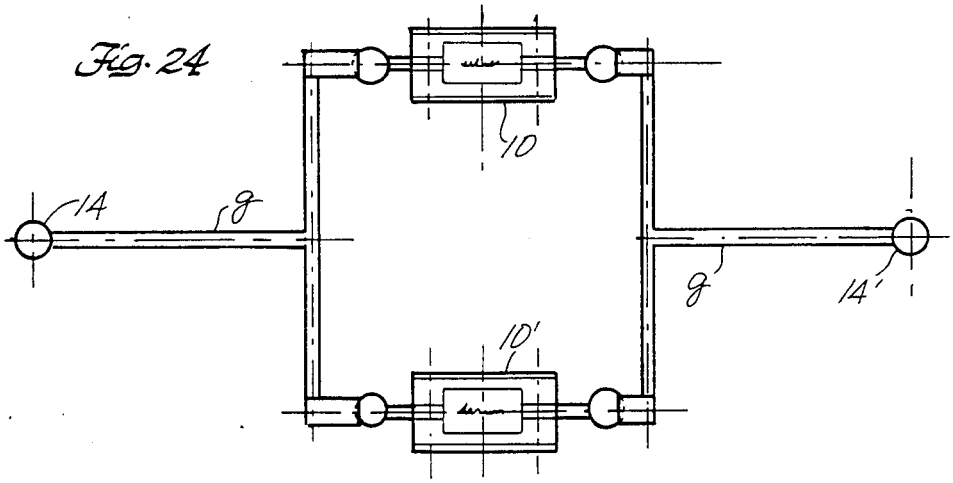

FIGS. 20 to 24 show some examples of lighting elements of most diverse design as may be inserted, for example, between the two magnetic holders 13 and 13' according to FIG. 1.As is evident from FIG. 24, additional connecting elements may be used here as well.

Figure 25:
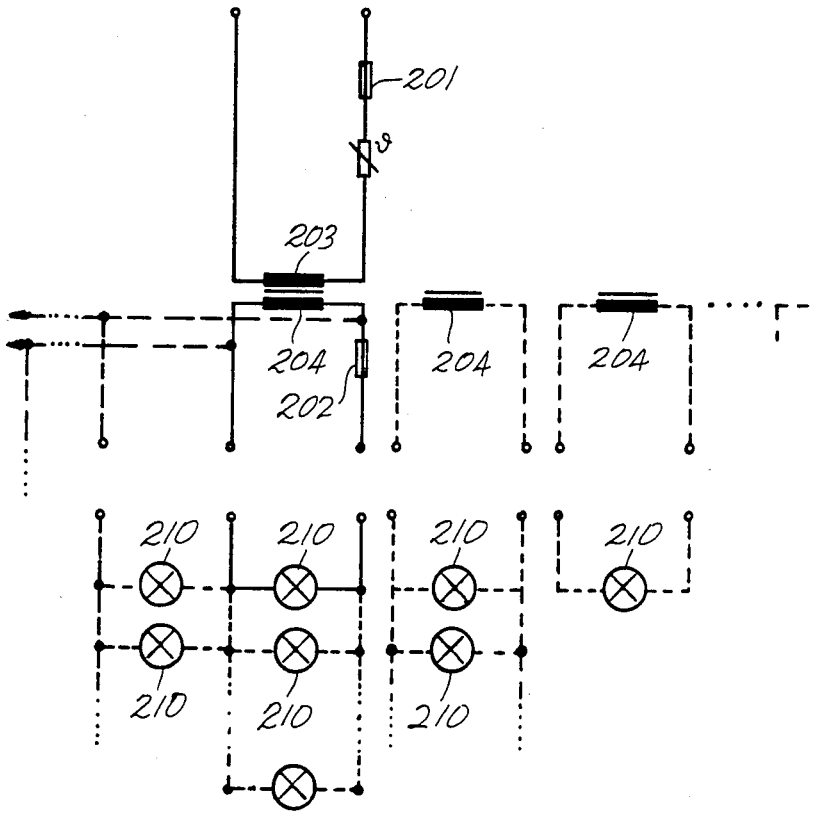
FIG. 25 is a circuit diagram showing the power supply of low-voltage incandescent lamps in schematic representation.

The lighting fixtures described above are fed with low-voltage, normally 12 or 24 V. When line-powered, a transformer is required. FIG. 25 shows an appropriate circuit diagram and the connections possible for several lighting fixtures, be it via single point connections or via a connection using a magnetic rail. In FIG. 25 reference numeral 201 indicates the fuse on the primary side, reference numeral 202 the one on the secondary side, and reference numeral 203 the primary-sided transformer, reference numberal 204 the secondary-sided transformer and reference numeral 210 indicates the individual lighting fixtures. On the right hand side of FIG. 25 the circuit for a single lighting fixture has been outlined, further to the left the circuit for a line of single point connections or a rail with separate transformer, and next to it on the left, several lines of single point connections or rails.

Light is turned on and off in conventional manner by means of a switch. An activation by means of a relay, a dimmer or—if appropriate, by means of remote control—renders the illumination system even more user-friendly.

Figure 26:
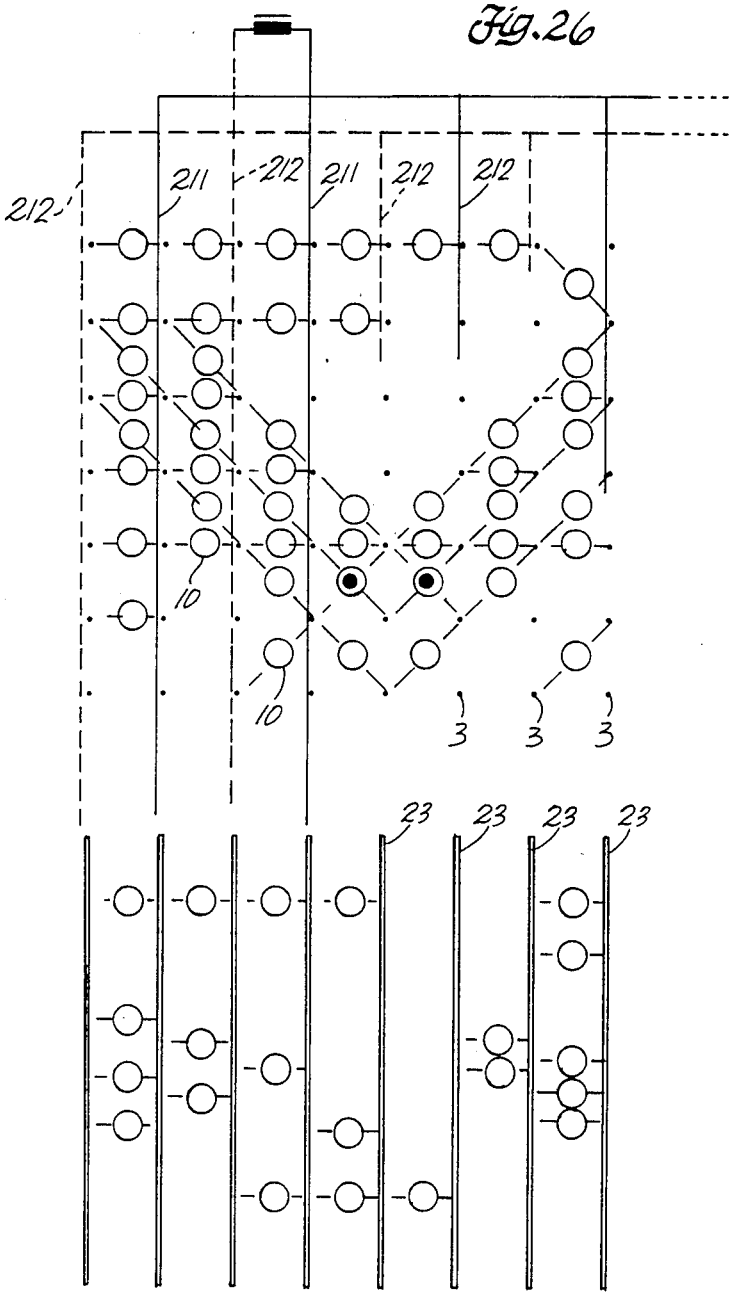
FIG. 26 is a circuit diagram for parallel power supply to a graticule illumination system comprised of a plurality of magnetic holders.

If several lighting fixtures are to be attached at different positions in a room, this may be realized by means of an array of magnetic holders 3,13 or magnetic rails 23, 53. The upper section of FIG. 26 represents an array of magnetic holders 3 for graticule illumination, whereas the lower section of FIG. 26 represents an array of magnetic rails 23 for graticule illumination. FIG. 26 also illustrates how the individual positions of the array chosen for graticule illumination are supplied with electrical power via leads 211,212. Some of the possibilities of connecting lighting fixtures 10 are outlined in this Figure as well.

Figure 27:
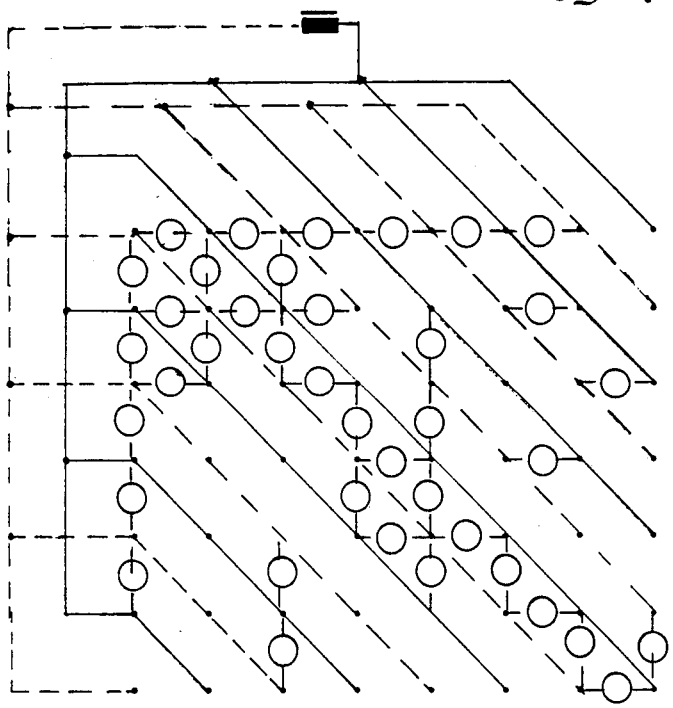
FIG. 27 is a circuit diagram for diagonal power supply to a graticule illumination system comprised of a plurality of magnetic holders.

FIG. 27 shows a diagonal power supply to the individual points of the graticule illumination array. This results in various possible connections for the lighting fixtures.

Arranging the magnetic holders or rails for graticule illumination as described above, renders it possible to attach several lighting fixtures in a room at different positions as well as to suspend one or more lighting fixtures at different places in the room.

All embodiments, features and advantages of the invention emerging from the description, the claims and the drawings, including details of design and spatial layout, both individually as well as in any combination, form vital ideas of the invention.

I claim:

1. A connection between two mechanically and electrically releasably coupled parts in particular for use with an illumination system with the two parts (3,4) being interconnectable by means of magnetic force and establishing electrical contact through mutual contacting as a result of magnetic frictional contact, characterized by the two parts (3,4) being interconnected in a hinge-type manner, each part comprising two electrically separated sections, the electrical separation of the individual sections being maintained when said pairs are connected, the connections between sections each comprising a magnetic holding member (33) and a ball (34) retained to said holding member by magnetic force, the magnetic holding member (33) being magnetically and physically connected to the ball (34) via an annular surface (38), the ball (34) having an internal contact pin (41) projecting from said ball and being electrically insulated from the ball (34), and a contact surface (39) in an interior of the magnetic holding member (33) and electrically insulated therefrom, said contact surface contacting exclusively the contact pin (41) of the ball (34) when the ball (34) is inserted.

2. Connection according to claim 1, characterized by the contact surface (39) being curved to match the shape of the ball (34).

3. Connection according to claim 1, characterized by the contact surface (39) being formed with rest recesses (47) for the contact pin.

4. Connection according to claim 1, characterized by the contact pin (41) being movable in longitudinal direction between two extreme stops (47) against spring resistance.

5. A connection between two mechanically and electrically releasably coupled parts, in particular for use with an illumination system with the two parts being interconnectable by means of magnetic force and establishing electrical contact through mutual contacting as a result of magnetic frictional contacts, characterized by the two parts being interconnected in a hinge-type manner, a first part being designed as a rail and a second part being magnetically attachable along said rail at any position desired, the rail being furnished with a contact rail which extends along a center line of the rail and electrically insulated from said rail and, when the second part is inserted, which contacts a contact element electrically insulated from and attached to the second part.

6. An illumination system comprising connections characterized by two basic connections (3,4 and 3',4', respectively) being provided, with an electrical consumer (10) being connected therebetween, each of the connections being mechanically and electrically releasably coupled by means of magnetic force and establishing electrical contact through mutual contacting as a result of magnetic frictional contact, the two parts (3,4) being interconnected in a hinge-type manner wherein said illumination system comprises a plurality of connected magnetic holding members arranged on a static wall structure in an array for graticule illumination.

7. Illumination system according to claim 6, characterized by at least one of the basic connections (3,4) being electrically connected via an intermediate member (5) to a further connection (13,14) and by the further connection (13,14) being electrically connected via an interposed electrical consumer (10) to the other basic connection (3',4') or to a further connection (13',14') operatively connected to said basic connection (3',4') via an interposed further intermediate member (5').

8. An illumination system comprising between two mechanically and electrically releasably coupled parts (3,4) interconnectable by means of magnetic force and establishing electrical contact through mutual contacting as a result of magnetic frictional contact, the two parts (3,4) being interconnected in a hinge-type manner, one part (33) comprising two electrically separated sections (36a,39), and by the other part (34) likewise comprising two electrically separated sections (34,41), the electrical separation of the individual sections being maintained when said parts (33,34) are connected, and the connection (33,34) being electrically connected to a further connection via an intermediate member (45), and by the latter being connected to the electrical consumer (10).

9. Illumination system according to claim 7 or 8, characterized by the intermediate member being an elongated support means.

10. Illumination system according to claim 7 or 8, characterized by the intermediate member being a telescopic element (205").

11. A magnetically mounted lamp, the holding of which comprises a permanent magnet provided with magnetic poles, contact of which magnet to a magnetizable counterpart establishes electrical contact of a power supply of the lamp, comprising a convex rotary body comprising magnetizable material applied to the magnetic poles in such a way that the convex rotary body is able to perform swinging motions about at least one axis, a contact surface electrically isolated with respect to the magnetic poles and such a rotary body within the magnetic poles, which contact surface is connected condition of the magnet holder extends at a distance from an outer surface of the rotary body and has a convex curvature corresponding to the convex curvature of the rotary body, and a contact pin in the rotary body being electrically isolated with respect to the rotary body and movable between two end stops in the longitudinal direction, and means for spring biasing the contact pin toward the contact surface, and wherein the rotary body and the magnetic poles on the contact surface are connected to different poles of the power supply of the lamp.

12. A lamp according to claim 11 wherein the rotary body comprises a magnetizable ball, the lower half of which is surrounded by a pair of magnetic poles.

13. A lamp according to claim 11 wherein the rotary body comprises a ball and the magnetic poles form a magnetic rail on which the ball is displaceable in a longitudinal direction of the magnetic rail.

14. A lamp according to claim 11 comprising a plurality of engagement recesses formed in the contact surface for engaging the spring-loaded contact-pin for fixing the contact pin in specific positions of the rotary body.

15. A lamp according to claim 11 comprising an intermediate member fixed to the rotary body and a further magnetic ball-and-socket joint between the lamp and the intermediate member.

16. A lamp according to claim 11 wherein the rotary body comprises a cylinder and the magnetic poles form a magnetic rail on which the cylinder is displaceable in a longitudinal direction of the magnetic rail.

17. A magnetically mounted lamp, a holder of which comprises a permanent magnet, a contact of which to a magnetizable counterpart establishes the electrical contact of a power supply of the lamp, comprising at least two ball-and-socket joints at a fixing surface for the lamp and connected to different poles of the power supply of the lamp for establishing electrical contact when the magnetic contact is connected, said joints being hinged to a connecting member bearing the lamp by means of an intermediate member each bearing a further ball-and-socket joint.

18. A lamp according to claim 17 wherein the intermediate member comprises an elongated rigid member provided with electrical conductors.

19. A lamp according to claim 17 wherein the intermediate member comprises an electrically conducting rope.

20. A lamp according to claim 17 wherein the intermediate member can telescope.

21. A lamp according to claim 17 wherein the intermediate member comprises a plastic disc provided with electrical conductors.

22. A lamp according to claim 17 wherein a plurality of magnetic holding members are disposed at the ceiling or wall of a room, each such member being connected to different poles of the power supply of the lamp.

23. A lamp according to claim 17 wherein a plurality of magnetic holding members are spread over the ceiling or wall of a room in a grid-shaped pattern.

24. A lamp according to claim 17 wherein at least one of the ball-and-socket joints comprises a magnetic rail having two ledge-shaped magnetic poles connected to the same electrical pole, and a spherical magnetizable body for contacting the magnetic poles.

* * * * *